US010051932B2

(12) United States Patent
Roncato et al.

(10) Patent No.: US 10,051,932 B2
(45) Date of Patent: Aug. 21, 2018

(54) RIGID SUITCASE

(71) Applicant: Valigeria Roncato S.p.A., Campodarsego (IT)

(72) Inventors: Cristiano Roncato, Campodarsego (IT); Enrico Roncato, Campodarsego (IT)

(73) Assignee: VALIGERIA RONCATO S.P.A., Campodarsego PD (IT)

( * ) Notice: Subject to any disclaimer, the term of this patent is extended or adjusted under 35 U.S.C. 154(b) by 226 days.

(21) Appl. No.: 14/905,141

(22) PCT Filed: Jul. 16, 2014

(86) PCT No.: PCT/IB2014/063141
§ 371 (c)(1),
(2) Date: Jan. 14, 2016

(87) PCT Pub. No.: WO2015/008228
PCT Pub. Date: Jan. 22, 2015

(65) Prior Publication Data

US 2016/0150860 A1 Jun. 2, 2016

(30) Foreign Application Priority Data

Jul. 17, 2013 (IT) ..... MI2013A1199

(51) Int. Cl.
*A45C 5/03* (2006.01)
*A45C 7/00* (2006.01)
(Continued)

(52) U.S. Cl.
CPC ..... *A45C 7/0045* (2013.01); *A45C 5/03* (2013.01); *A45C 13/103* (2013.01); *A45C 13/18* (2013.01); *A45C 2005/037* (2013.01)

(58) Field of Classification Search
CPC .. A45C 3/00; A45C 13/02; A45C 5/00; A45C 3/004; A45C 3/02
(Continued)

(56) References Cited

U.S. PATENT DOCUMENTS 4,122,925 A 10/1978 Schultheiss
4,673,070 A * 6/1987 Ambal ..... A45C 3/00 150/111
(Continued)

FOREIGN PATENT DOCUMENTS

GB 2489832 A 10/2012
JP S55157426 U 11/1980
(Continued)

*Primary Examiner* — Fenn C Mathew
*Assistant Examiner* — Cynthia Collado
(74) *Attorney, Agent, or Firm* — Volpe and Koenig, P.C.

(57) ABSTRACT

A rigid suitcase includes first and second shells defining a first storage volume, the outer surface of the first shell including a recess, and an auxiliary container defining a second storage volume, physically separate from the first storage volume, and adapted to be moved between an inserted state in which the auxiliary container is at last partially housed in the recess and a removed state, in which the auxiliary container is completely extracted from the recess. The rigid suitcase further includes guide members operable to guide the auxiliary container as it moves from the inserted state to the removed state and vice versa, and removable attachment members operable between the first shell and the auxiliary container and adapted to be actuated between an attached state, in which the auxiliary container cannot be removed from the recess and a released condition in which the auxiliary container can be removed.

16 Claims, 4 Drawing Sheets

(51) Int. Cl.
*A45C 13/10* (2006.01)
*A45C 13/18* (2006.01)

(58) Field of Classification Search
USPC ..... 190/111, 109, 100, 108, 18 A; 224/616; 220/520; 280/47.17
See application file for complete search history.

(56) References Cited

U.S. PATENT DOCUMENTS

| | | | | | |
|---|---|---|---|---|---|
| 5,230,450 | A * | 7/1993 | Mahvi | A45C 7/0045 | 190/108 |
| 5,429,235 | A * | 7/1995 | Chen | A45C 7/0045 | 206/372 |
| 6,213,266 | B1 * | 4/2001 | Hollingsworth | A45C 5/14 | 150/111 |
| 9,365,311 | B1 * | 6/2016 | Sibbett | A45C 11/00 | |
| 9,469,024 | B2 * | 10/2016 | Bensman | B25H 3/023 | |
| 2006/0006036 | A1 * | 1/2006 | Godshaw | A45C 5/06 | 190/109 |
| 2006/0243550 | A1 * | 11/2006 | Morszeck | A45C 5/06 | 190/124 |
| 2013/0279090 | A1 * | 10/2013 | Brandt | H05K 7/00 | 361/679.01 |

FOREIGN PATENT DOCUMENTS

| | | | | | |
|---|---|---|---|---|---|
| WO | WO 2004112529 | A1 * | 12/2004 | A45C 7/0045 | |
| WO | 2013037912 | A1 | 3/2013 | | |

* cited by examiner

FIG 7
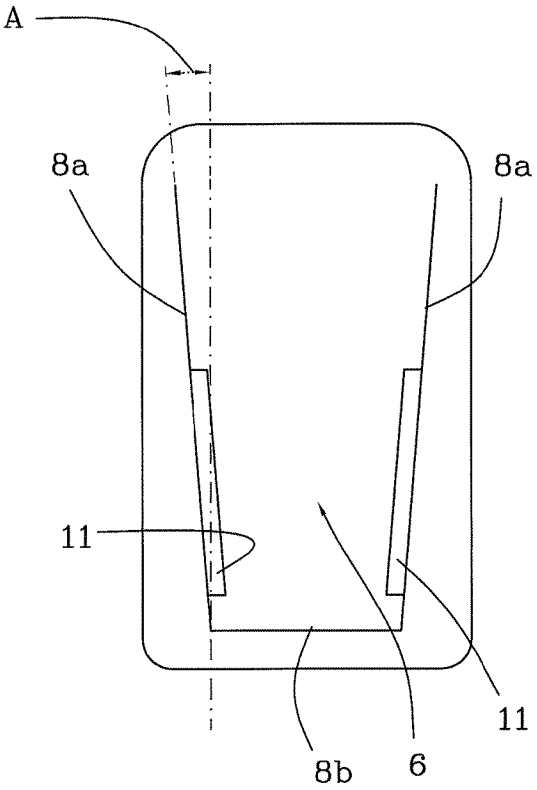
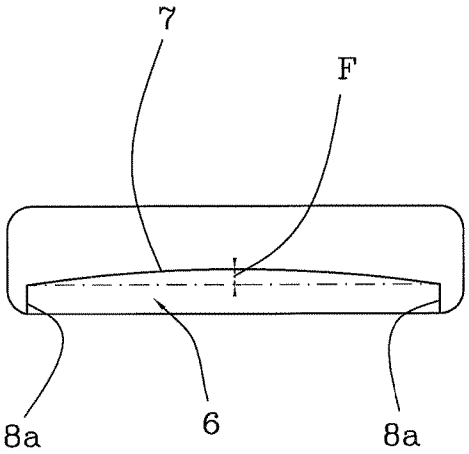
FIG 6
FIG 5
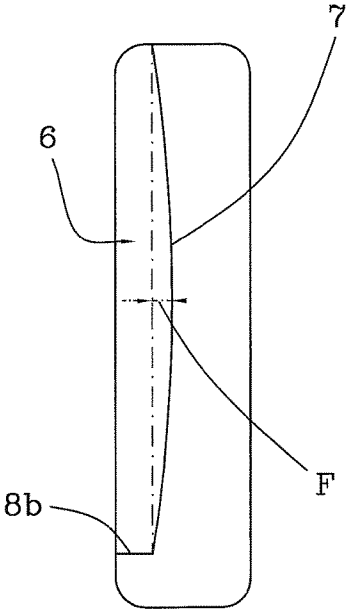

RIGID SUITCASE

CROSS-REFERENCE TO RELATED APPLICATIONS

This application is a 371 of International Application No. PCT/IB2014/063141 filed on Jul. 16, 2014, which claims the benefit of Italian Application No. MI2013A001199, which was filed on Jul. 17, 2013, and are incorporated herein by reference as if fully set forth.

FIELD OF INVENTION

The present invention relates to a rigid suitcase.

BACKGROUND

As used in this disclosure and the claims annexed thereto, the term rigid suitcase is intended to relate to transportable luggage, such as a carry-on case, a suitcase and the like, as used to carry personal belongings, e.g. during a business or pleasure trip, of the type composed of two mutually articulated plastic shells. Such suitcases differ from soft suitcases, which are made up of a frame covered by flexible fabric sheets.

Rigid suitcases are usually composed of two mutually hinged shells which define an interior volume for containing personal belongings. Such interior volume is often divided into multiple compartments for organized retention of items of different types, such as garments and shoes, while preventing such items from getting damaged during transport. The typical rigidity of rigid luggage shells prevents the contents in the interior volume from being excessively pressed during transport.

There is a growing demand by rigid suitcase users for easily and readily accessible containing compartments. For example, during boarding at an airport, travel and identity documents should be ready at hand for submission but also kept with care. In these situations, it would not be feasible to keep documents in the volume defined by the two suitcase shells. In order to address such kinds of requirements, rigid suitcases have been developed, which have one or more soft fabric pockets sewn or bonded to the outer wall of one of the two suitcase shells. This arrangement obviates the above mentioned drawback, as it provides a readily accessible containing space, separate from the interior volume defined by the two shells.

Nevertheless, this type of rigid suitcase still has a few drawbacks.

The pocket is not easily sewn and bonded to the suitcase shell, a number of steps being required therefor, which increase manufacturing costs and are reflected in often high sale prices.

Furthermore, when a pocket is sewn to the outer shell of a suitcase, especially when sewing is not properly done, water-tightness of the suitcase might be affected, with possible water infiltrations when the suitcase is exposed to rain.

Also, if the size of the suitcase requires it to be boarded separately from its owner, the latter will no longer have the suitcase, and hence the contents of the soft pocket, readily available.

In the light of the above described prior art, the technical purpose of the present invention is to provide a rigid suitcase that obviates the above drawbacks.

Particularly, the object of the present invention is to provide a rigid suitcase that can provide additional containing space for easy and ready access by its user.

According to the present disclosure, the technical purpose and the intended object are fulfilled by a rigid suitcase as defined by the features of one or more of the annexed claims.

BRIEF DESCRIPTION OF THE DRAWINGS

The features and advantages of the invention will appear from the following detailed description of an embodiment, which is illustrated without limitation in the annexed drawings, in which:

FIGS. 5 and 6 are schematic sectional views of the suitcase of FIG. 1, as taken along the axes V-V and VI-VI, and FIG. 7 is a schematic front view of the suitcase of FIG. 1.

Figure 1:
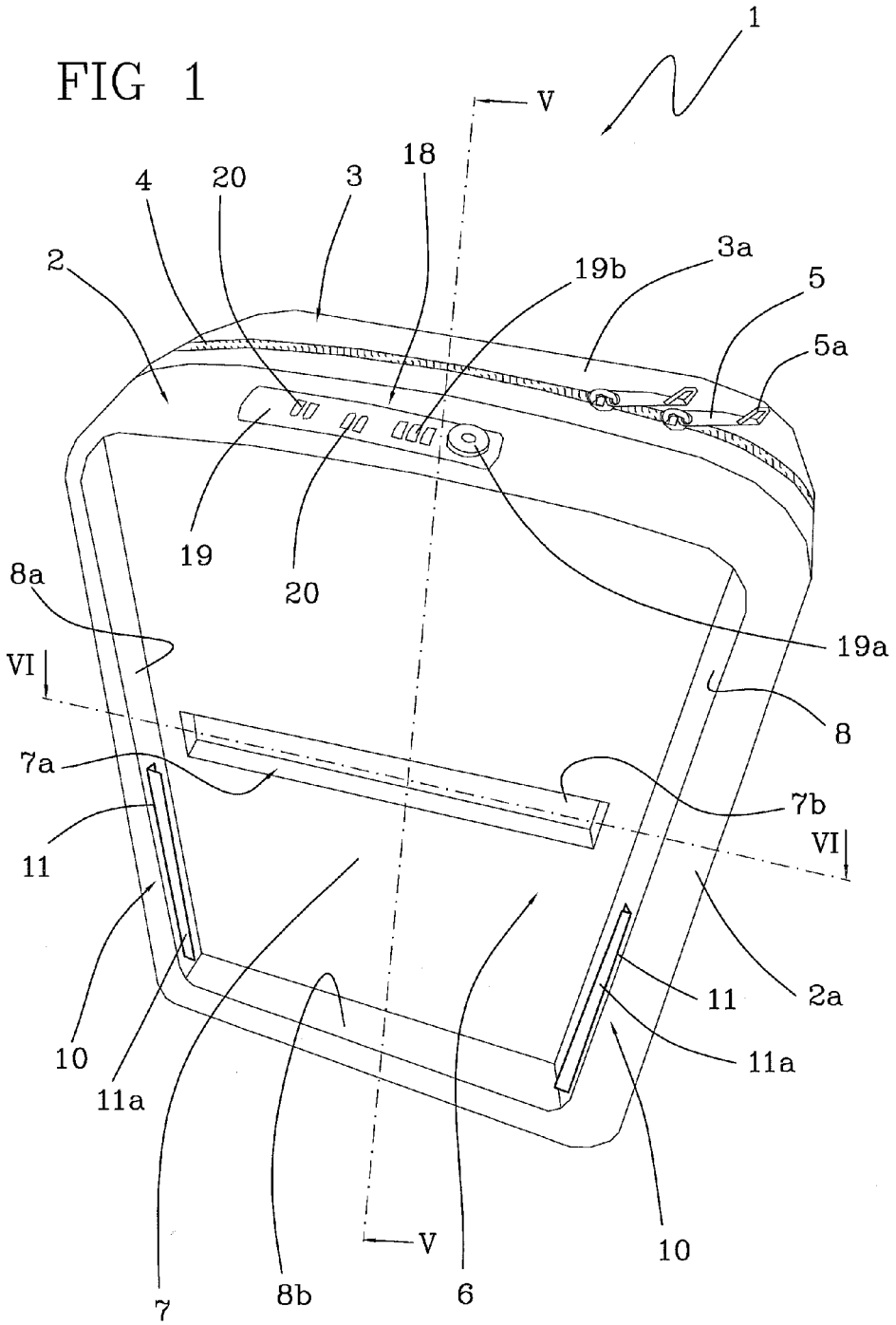
FIG. 1 shows a perspective view of a first part of a rigid suitcase of the present invention.

The above mentioned figures shall be intended as not being necessarily drawn to scale, and with the various components in their relative proportions.

DETAILED DESCRIPTION OF THE PREFERRED EMBODIMENTS

Referring to the annexed figures, numeral 1 generally designates a rigid suitcase of the present invention.

As used herein, the term "rigid" suitcase is intended to designate a suitcase whose shells are made of a material that can resist impacts and compression without being significantly deformed, thereby protecting the suitcase contents. In other words, the term "rigid" suitcase designates a type of suitcases that differs from "soft" suitcases, i.e. those made of fabric or the like, which become deformed and lose their original shape when subjected to even light pressure.

The rigid suitcase 1 comprises a first shell 2 and a second shell 3 which are hinged to each other and have outer surfaces 2*a*, 3*a* and inner surfaces (not shown) respectively. Preferably, the shells 2, 3 are thermoformed or formed by injection of polymeric or composite materials.

The inner surfaces face each other to define a first storage volume. The outer surfaces 2*a*, 3*a* are opposite to the inner surfaces and face away from the first interior storage volume of the suitcase. The outer surfaces 2*a*, 3*a* define the shape and size of the suitcase. It shall be noted that the first and second shells may have accessories associated therewith, such as one or more handles for suitcase transportation, a pull-out handle, a plurality of wheels for easily pulling on the suitcase without lifting it from the ground, and else.

The first shell 2 and the second shell 3 are adapted to be attached to each other to enclose the first storage volume, by means of a zipper 4 having at least one sliding clip (5) for closing and opening the zipper. In the preferred embodiment of the invention, the zipper 4 has two sliding clips 5. The zipper 4 extends substantially along three quarters of the free peripheral edge of each shell, such that the suitcase may be fully closed or opened in hinged fashion.

As shown in FIG. 1, the outer surface 2*a* of the first shell 2 comprises a recess 6 projecting into the first storage volume. The recess 6 is configured as a space delimited by a bottom wall 7 and side walls 8 that are part of (or anyway attached to) the outer surface 2*a* of the first shell. The side walls 8 of the recess are preferably three in number, particularly two opposed side walls 8*a* and a base side wall 8*b* which extends between the two opposed side walls. The base side wall 8*b* is arranged on the side facing the bottom of the suitcase, i.e. the portion of the suitcase that is designed to act as a base, or has wheels. The side walls 8 extend from the bottom wall 7 and away from it. It shall be noted that the recess 6 is accessible from the front, i.e. from the side opposite to that of the bottom side wall 7. Furthermore, the recess 6 is accessible from above, i.e. from the side opposite to that of the base side wall 8*b*.

The recess 6 defines a housing for an auxiliary container 9. The latter defines a second storage volume, which is physically distinct from the first storage volume for receiving additional material separately and independently from the first storage volume. It shall be noted in this respect that access to the second storage volume is independent from access to the first storage volume. Particularly, access to the second storage volume is allowed even when access to the first storage volume is inhibited (such as by closing together the shells by the zipper). It shall be noted that the second storage volume is preferably much smaller than the first storage volume. For example, the first storage volume has at least three times the volume capacity of the second storage volume.

The auxiliary container 9 is adapted to be moved between an inserted state, in which it is at least partially housed in the recess 6 and is joined to the first shell and a removed state, in which it is completely extracted from said recess (6) and is physically independent from the first shell 2 and the second shell 3.

Figure 2:
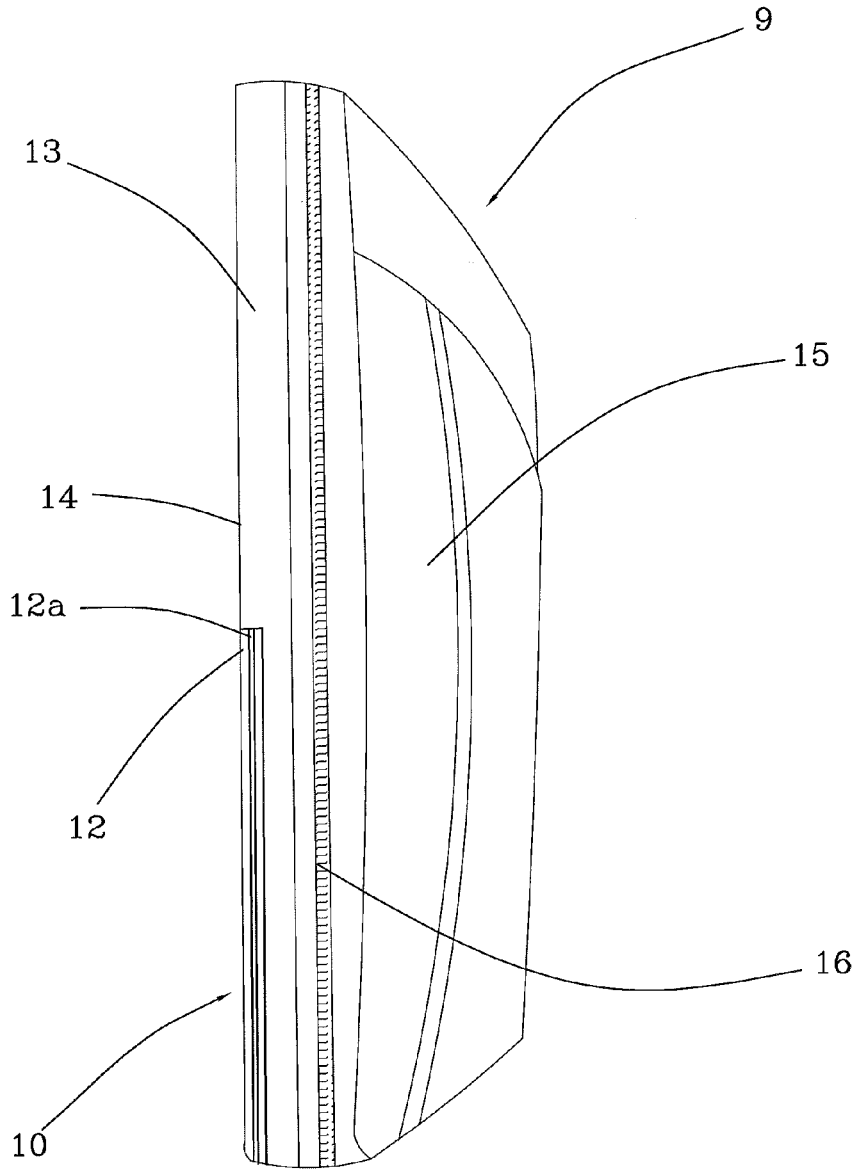
FIG. 2 shows a perspective view of a second part of the rigid suitcase of FIG. 1.
Figure 3:
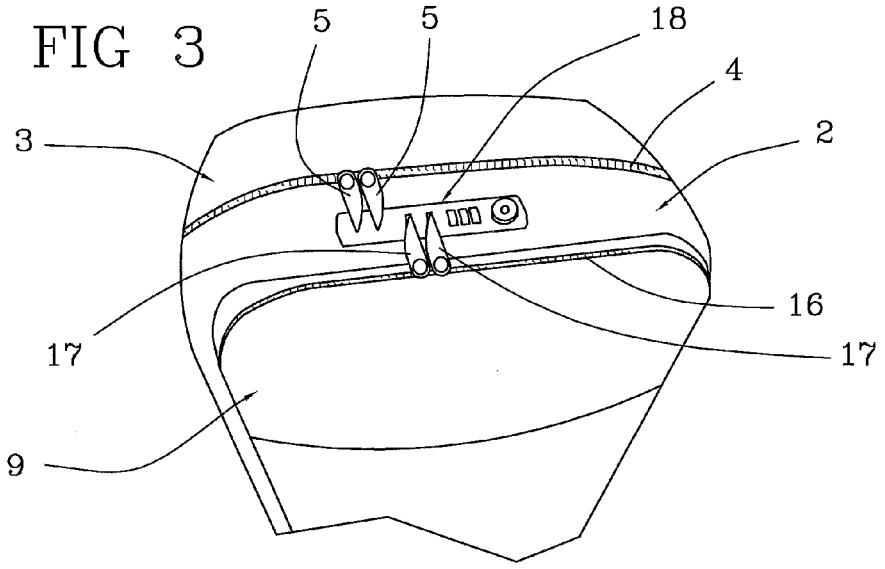
FIG. 3 shows a perspective view of the two parts of the rigid suitcase of FIGS. 1 and 2 in mutually associated relationship.

It shall be noted that, when the auxiliary container 9 is in the inserted state, it is joined to the first shell 2 and becomes an integral part of the suitcase (see FIG. 3). On the other hand, when the auxiliary container 9 is in the removed state, it is independent from the first and second shells and actually acts as a distinct bag, physically separated from the suitcase (see FIG. 2). In this respect, the auxiliary container may 9 may have a strap (not shown) for easy transportation thereof when removed.

The rigid suitcase 1 comprises guide members 10 operable between the recess 6 and the auxiliary container 9 and designed to guide the auxiliary container 9 as it moves from the inserted state to the removed state and vice versa.

Figure 4:
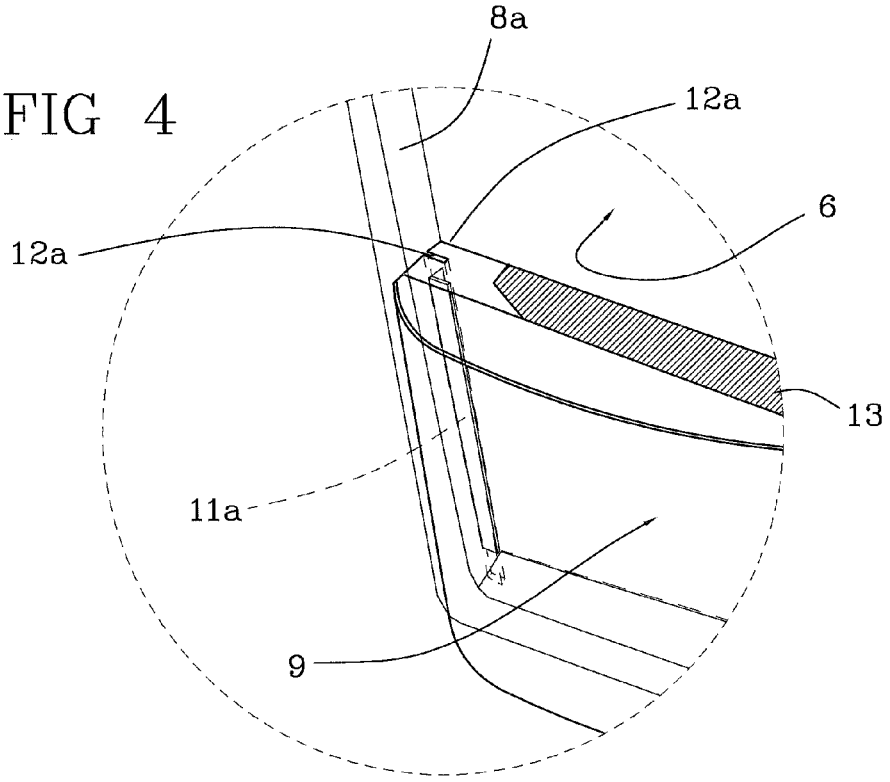
FIG. 4 shows an enlarged perspective view of the two mutually associated parts of the suitcase with certain components omitted to highlight other components.

Preferably, the guide members 10 comprise substantially rectilinear projections 11 which are joined to at least one side wall of the recess 6 or with the auxiliary container 9, and slidably engage grooves 12 joined to the auxiliary container 9 or to at least one side wall of the recess 6. In the preferred embodiment of the invention, the projections 11 are joined to the side walls 8 of the recess 6 and the grooves 12 are joined to the auxiliary container 9. The projections 11 comprise at least one wing 11*a* integral with the first shell 2 and the grooves 12 comprise at least one channel 12*a* formed in the auxiliary container 9 (see FIG. 4).

Preferably, a respective projection 11 is placed on each side wall 8*a* of the recess 6. Each recess 11 consists of a straight L-shaped section. Each recess comprises a wing 11*a* extending away from its respective side wall 8*a* (see FIG. 1) of the recess 6. Each wing 11*a* engages respective channel 12*a* in the inserted state of the auxiliary container 9 (see FIG. 4). The projections may be formed, for instance, from a polymeric or metal material and be bonded to their respective side walls of the recess 6.

In the preferred embodiment of the invention, each wing 11*a* extends from its respective side wall 8*a* to a length of at least 10 mm, preferably from 10 mm to 25 mm, more preferably about 12 mm. Thus, engagement is ensured between the wings 11*a* and the channels 12*a* even when the auxiliary container 9 is deformed, e.g. by the contents of the auxiliary container 9 itself. It shall be noted that, when the auxiliary container 9 is filled, it might become slightly deformed due to the outward pressure exerted by the material contained therein, which would reduce its cross-sectional dimension (i.e. the dimension measured in the direction between the two opposed side walls 8*a* of the recess 6).

In view of reducing the degree of deformation of the auxiliary container 9, the latter comprises at least one portion made of a rigid material 13 which, in the inserted state, faces the bottom wall 7 and extends between the side walls 8*a* of the recess 6. This rigid portion 13 has the purpose of reducing the amount of deformation and prevent the auxiliary container 9 from accidentally coming out of the recess 6. In the preferred embodiment of the invention, the rigid portion 13 covers an entire wall of the auxiliary container, particularly a rear wall 14 thereof. This rear wall 14 is hidden to the view when the auxiliary container 9 is in the inserted state. Furthermore, the rear wall 14 has substantially the same size as the bottom wall 7 of the recess 6, such that the auxiliary container 9 is entirely and snugly contained in the recess 6.

The rear wall 14 of the auxiliary container 9 and/or the bottom side wall 7 of the recess 6 is not flat, but concave. Particularly, if the rear wall 14 of the auxiliary container 9 is concave, its concavity faces toward the exterior of the auxiliary container 9 such that the central portion of the rear wall 14 is farther from the bottom side wall 7 of the recess than the peripheral portions of the rear wall 14. If the bottom side wall 7 of the recess is concave, its concavity faces toward the exterior of the suitcase (i.e. the volume defined by the two shells when closed) such that the central portion of the bottom side wall 7 is farther from the rear wall 14 of the auxiliary container 9 than the peripheral portions of the bottom side wall 7.

Thus, when the first storage volume (i.e. the volume defined by the two shells of the suitcase) is filled by a user, any deformation of the bottom side wall 7 is compensated for, thereby preventing the auxiliary container 9 from being subjected to excessive pressure, that might damage the projections 11. It shall be noted that, while the shells of the suitcase are of "rigid" type, they still retain a certain degree of deformability, as determined both by suitcase weight reduction requirements (which are reflected on the thickness of the shell material) and by the fact that suitcase shells should be allowed some elastic deformation, though little, to prevent any failure or dents.

Preferably, the shape of the bottom side wall 7 of the recess 6 and/or the rear wall 14 of the auxiliary container 9, which is adapted to form the above mentioned concavity, is obtained by continuously tapering the wall from the peripheral ends to the center thereof (as schematically shown in FIGS. 5 and 6, relative to the bottom side wall 7 of the recess 6). In other words, the bottom side wall 7 of the recess 6 and/or the rear wall 14 of the auxiliary container 9 has a rounded ogival shape, where the apex of the ogive is located substantially at the center of the wall and is connected to the peripheral edges of the wall by continuously tapering curved surfaces. The apex of the rounded ogive and the curved wall that connects it to the peripheral edges of the wall have no point of infection.

The camber F of the concavity, which is intended as the maximum distance of the bottom side wall 7 of the recess 6 and/or the rear wall 14 of the auxiliary container 9 from an ideal flat wall that passes through the peripheral edges of the respective wall (see FIGS. 5 and 6) ranges from 1 mm to 20 mm, preferably from 2 mm to 8 mm, and is more preferably about 5 mm. In the preferred embodiment of the invention, only the bottom side wall 7 of the recess 6 has the above described concavity.

Also, in order to further avoid any deformation when the first storage volume is filled, the bottom side wall 7 of the recess has a transverse rib 7*a*, extending between the side walls 8*a* of the recess 6 (see FIG. 1). This rib 7*a* is preferably formed during molding (or during injection) of the shell half with the recess 6, such that it forms one piece with the bottom wall 7. Particularly, the rib 7*a* is obtained by directly forming a groove on the bottom wall 7. The groove comprises a bottom wall 7*b* which is parallel to and spaced from the bottom wall 7 of the recess and four side walls that connect the bottom wall 7*b* of the groove to the bottom wall 7 of the recess.

The bottom wall 7*b* of the groove projects toward the first storage volume.

Preferably, the side walls of the groove are perpendicular to the bottom wall 7*b* thereof. In the preferred embodiment of the invention, the bottom wall 7*b* of the groove is offset from the bottom wall 7 of the recess by a distance that ranges from 3 mm to 15 mm, and is preferably about 5 mm. The term offset is intended to mean that the bottom wall 7*b* of the groove lies on a surface that is parallel to and spaced from the surface with the bottom wall 7 of the recess.

Preferably, the bottom wall 7*b* of the groove 7*a* extends from 30% to 90%, preferably to about 80% the distance between the side walls of the recess 8*a*.

The groove 7*a* is preferably placed at the maximum-camber point (the apex of the ogive) of the bottom wall 7 of the recess 6, as shown in FIG. 1. It should be noted that the groove 7*a* is hidden in FIGS. 5, 6 and 7.

The rigid portion 13 has a front wall 15 of the auxiliary container 9 attached thereto, which is visible when the auxiliary container 9 is in the inserted state (see FIG. 3).

The grooves 12 and their respective channels 12*a* are formed in the rigid portion 13 of the auxiliary container 9. Thus, the auxiliary container 9 may be introduced into the recess 6 by causing the grooves 12 to slide along the projections 11. Such coupling arrangement allows the auxiliary container 9 to slide in the straight direction of extension of the projections 11 and blocks any further degree of freedom between the auxiliary container 9 and the first shell 2. It will be thus appreciated that any relative movement between the auxiliary container 9 and the first shell perpendicular to the bottom wall 7 of the recess 6 is prevented by the engagement between the grooves 12 and the projections 11.

In order to allow the auxiliary container 9 to be more easily and readily introduced into the recess 6, the projections 11 and preferably also the side walls 8*a* of the recess 6 with which the projections 11 are engaged, are not parallel but converge to an ideal point external to the footprint of the suitcase. Particularly, the distance between the projections 11 as measured near the top of the recess 6, i.e. the portion of the recess opposite to the base side wall 8*b*, is greater than the distance between the projections 11 as measured near the base side wall 8*b* of the recess 6. Particularly, the inclination A of each projection 11 with respect to ideal lines parallel and perpendicular to the base side wall 8*b* of the recess (see FIG. 7) ranges from 1° to 10°, and is preferably about 3°. Likewise, the grooves 12 of the auxiliary container 9, and preferably also the walls of the auxiliary container in which the grooves 12 are formed, have the same inclination as the projections 11, such that the projections 11 and their respective grooves 12 are parallel. The auxiliary container 9 comprises at least one zipper 16 having at least one sliding clip 17 for providing access to the auxiliary container itself (i.e. the second storage volume).

The suitcase 1 also comprises removable attachment members 18 operable between the first shell 2 and the auxiliary container 9 and adapted to be actuated between an attached state, in which the auxiliary container 9 cannot be removed from the guide members 10 (and hence from the recess 6) and a released condition in which the auxiliary container 9 can be removed from the guide members 10 (and hence from the recess 6).

The removable attachment members 18 comprise an anchor element 19 having respective slots 20 for receiving and holding a portion of the sliding clip 5 of the zipper 4 of the two shells and a portion 17*a* of the sliding clip 17 of the zipper 16 of the auxiliary container 9. When the sliding clip portions are inserted in their respective slots 20, the latter retain the sliding clips, thereby preventing them from moving and opening the suitcase for access to both the first and second interior volumes. It shall be noted that the retaining action on the sliding clip 17 of the auxiliary container 9 prevents relative translation between the projections 11 and the grooves 12, thereby actually preventing the auxiliary container 9 from being slid off the recess 6.

In the preferred embodiment of the invention, each of the zipper 5 of the two shells 2, 3 and the zipper 16 of the auxiliary container 9 comprises two sliding clips having respective portions designed to fit into the above mentioned slots 20.

The anchor element 19 is preferably placed on the outer surface 2*a* of the first shell 2 on the side opposite to the base side wall 8*b* of the recess 6, such that it may be easily reached by a user.

The anchor element 19 has a pushbutton 19*a* for simultaneous release of the sliding clips from the slots.

This pushbutton 19*a* is operable by a safety system 19*b* which enables operation of the pushbutton. In the preferred embodiment of the invention, this safety system 19*b* may be a number combination padlock (like in the example of FIG. 3), a lock or the like.

The above disclosure clearly shows that the rigid suitcase of the invention fulfills the intended purposes.

Thus, when the auxiliary container 9 is in the inserted state, it is joined to and integral with the shells 2, 3 of the suitcase, and may be transported and moved at the same time as the rest of the rigid suitcase. In this configuration, the guide members 10 and the attachment members 18 prevent the auxiliary container 9 from being separated from the first shell 2. It will be appreciated that, in this configuration, the auxiliary container 9 has its own independent storage volume, which is physically separate from the storage volume defined by the two shells, and which may be accessed without opening the two suitcase shells. Therefore, the storage volume of the auxiliary container may be utilized for housing travel documents, as it is readily and simply reachable by the user.

When the auxiliary container is in the removed state, it is configured as a case, bag or backpack, completely independent from the shells 2, 3, i.e. from the first storage volume. Thus, the auxiliary container may be utilized to contain documents whose use is unrelated to the use of the material contained in the first storage volume of the suitcase, which allows, for instance, work documents to be organized and be readily available for use without the need of traveling with a dedicated case in addition to the traditional suitcase.

Also, the above described projections and grooves allow the auxiliary container to simply and easily move between the inserted state and the removed state, for practical and advantageous use thereof.

Obviously, the embodiments and examples as disclosed and illustrated herein shall be only intended by way of example, and those skilled in the art will appreciate that a number of changes and variants may be made to the rigid suitcase of the invention as described hereinbefore, including for instance the shape of the suitcase, the (rigid) materials of which it is made, its dimensions, without departure from the scope of the invention, as defined in the following claims.

The invention claimed is:

1. A rigid suitcase comprising:

a first shell and a second shell which are hinged to each other and have outer surfaces and inner surfaces respectively, wherein said inner surfaces face each other to define a first storage volume, the outer surface of said first shell comprising a recess projecting into said first storage volume and delimited by a bottom wall and side walls of the outer surface of the first shell;

an auxiliary container defining a second storage volume that is physically separate from said first storage volume, said auxiliary container being adapted to be moved between an inserted state, in which the auxiliary container is at least partially housed in said recess and a removed state, in which the auxiliary container is completely extracted from said recess;

guide members operable between said recess and said auxiliary container and designed to guide said auxiliary container as the auxiliary container moves from the inserted state to the removed state and from the removed state to the inserted state;

removable attachment members operable between said first shell and said auxiliary container and adapted to be actuated between an attached state, in which the auxiliary container cannot be removed from said guide members and a released condition in which the auxiliary container may be removed from said guide members;

wherein said bottom wall of the outer surface of said first shell in which said recess is formed is concave with a concavity facing toward the exterior of the first storage volume, so that a central portion of the bottom wall is farther from a rear wall of the auxiliary container than peripheral portions of the bottom wall, or wherein the rear wall of said auxiliary container facing said recess is concave with a concavity facing toward the exterior of the second storage volume, so that a central portion of the rear wall is farther from the bottom wall than peripheral portions of the rear wall.

2. The rigid suitcase as claimed in claim 1, wherein said side walls of the outer surface extend from said bottom wall; said auxiliary container comprising at least one portion made of a rigid material which, in its inserted state, faces the bottom wall and extends between the side walls of the recess.

3. The rigid suitcase as claimed in claim 2, wherein said guide members comprise substantially rectilinear projections integral with at least one side wall of the recess or with the auxiliary container, and slidably engage grooves integral with the auxiliary container or integral with at least one side wall of the recess.

4. The rigid suitcase as claimed in claim 3, wherein each projection is parallel to its respective groove and is inclined to an ideal line perpendicular to a base side wall of the recess by 1° to 10°.

5. The rigid suitcase as claimed in claim 3, wherein said projections comprise at least one wing integral with said first shell and said grooves comprise at least one channel formed in said auxiliary container; said wing engaging said channel in said inserted state of the auxiliary container.

6. The rigid suitcase as claimed in claim 3, wherein said projections or said grooves are integral with or formed in said rigid portion of said auxiliary container.

7. The rigid suitcase as claimed in claim 6, wherein said removable attachment members comprise an anchor element having respective slots for receiving and holding a portion of the sliding clip of the zipper of the two shells and a portion of the sliding clip of the zipper of the auxiliary container; said anchor element being placed on the outer surface of the first shell.

8. The suitcase as claimed in claim 7, wherein said anchor element has a pushbutton for simultaneous release of the sliding clips from the slots.

9. The rigid suitcase as claimed in claim 2, wherein said bottom wall has a rounded ogival shape, where the apex of the ogive is located substantially at the center of the bottom wall and is connected to the peripheral edges of the bottom wall by continuously tapering curved surfaces.

10. The rigid suitcase as claimed in claim 9, wherein the camber of said concavity ranges from 2 mm to 8 mm.

11. The suitcase as claimed in claim 1, wherein said outer surface of said first shell in which said recess is formed comprises a stiffening rib.

12. The suitcase as claimed in claim 11, wherein said rib comprises a groove formed directly on said bottom wall of the recess; said groove comprising a bottom wall which is offset from and parallel to the bottom wall of the recess.

13. The rigid suitcase as claimed in claim 1, wherein said first and second shells are adapted to be attached to each other by means of a zipper having at least one sliding clip for closing and opening the zipper and providing access to said first storage volume; said auxiliary container comprising at least one zipper having at least one closing and opening sliding clip to provide access to said second storage volume.

14. The rigid suitcase as claimed in claim 1, wherein said first storage compartment has at least three times the capacity of the second storage volume.

15. A rigid suitcase comprising:

a first shell and a second shell which are hinged to each other and have outer surfaces and inner surfaces respectively, wherein said inner surfaces face each other to define a first storage volume, the outer surface of said first shell comprising a recess projecting into said first storage volume;

an auxiliary container defining a second storage volume that is physically separate from said first storage volume, said auxiliary container being adapted to be moved between an inserted state, in which the auxiliary container is at least partially housed in said recess and a removed state, in which the auxiliary container is completely extracted from said recess;

guide members operable between said recess and said auxiliary container and designed to guide said auxiliary container as it moves from the inserted state to the removed state and from the removed state to the inserted state;

said guide members comprising substantially rectilinear projections which are joined to at least one side wall of the recess or to the auxiliary container and that slidably engage grooves joined to the auxiliary container or to at least one side wall of the recess;

wherein said projections are not parallel, and said projections converge to an ideal point external to a perimeter defined by the suitcase.

16. The rigid suitcase as claimed in claim 15, wherein a distance between the projections as measured at a portion of the recess opposite to a base side wall is greater than the distance between the projections as measured near the base side wall of the recess.

* * * * *